United States Patent [19]

Schaefer

[11] Patent Number: 4,734,965

[45] Date of Patent: Apr. 5, 1988

[54] AUTOMATIC WIRING NETWORK FABRICATOR

[75] Inventor: John O. Schaefer, Lexington, Ky.

[73] Assignee: International Business Machines Corporation, Armonk, N.Y.

[21] Appl. No.: 944,685

[22] Filed: Dec. 19, 1986

[51] Int. Cl.[4] ..... H01R 43/04

[52] U.S. Cl. ..... 29/33 M; 29/564.1; 29/566.3; 29/755; 29/857

[58] Field of Search ..... 29/564.1, 748, 749, 29/566.1, 566.3, 33 M, 855, 857

[56] References Cited

U.S. PATENT DOCUMENTS

| | | | |
|---|---|---|---|
| 3,936,933 | 2/1976 | Folk et al. | 29/749 |
| 3,956,822 | 5/1976 | Folk | 29/749 |
| 4,095,336 | 6/1978 | Throne | 29/566.3 |
| 4,136,440 | 1/1979 | Brandewie | 29/564.4 |
| 4,476,628 | 10/1984 | Kees, Jr. | 29/755 |
| 4,614,028 | 9/1986 | Rich | 29/857 |

FOREIGN PATENT DOCUMENTS

| | | | |
|---|---|---|---|
| 147081 | 7/1985 | European Pat. Off. | 29/749 |
| 169630 | 1/1986 | European Pat. Off. | 29/755 |
| 2937689 | 6/1980 | Fed. Rep. of Germany | 29/749 |
| 3235126 | 3/1984 | Fed. Rep. of Germany | 29/748 |
| 3521944 | 12/1986 | Fed. Rep. of Germany | 29/749 |
| 99994 | 8/1979 | Japan | 29/748 |

*Primary Examiner*—William R. Briggs
*Attorney, Agent, or Firm*—Laurence R. Letson

[57] ABSTRACT

A device for automated manufacture of wiring harness is described. The device feeds the wires through a number of channels in a die to position the wires at the proper termination points and then terminates the wires in connectors. The wiring harness assembly device permits the automated assembly of wiring harnesses which have wires which interconnect the connectors at positions which do not positionally correspond.

9 Claims, 2 Drawing Sheets

AUTOMATIC WIRING NETWORK FABRICATOR

This invention relates to the field of wiring harnesses or wiring networks, sometimes referred to pigtails. The invention more specifically is a device that permits and performs the automation of the fabrication of the wiring networks.

BACKGROUND OF THE INVENTION

Wiring harnesses typically interconnect two or more connectors, which then may be mated with other connectors. The requirements for the wiring network may be such that the wires do not connect with the same relative position on each of the connectors and the connector on one end of the network may be a double row connector while the connector on the other end may be a single row connector.

These requirements have heretofore dictated that the networks be hand wired. Also, the potential use of a flat ribbon type cable is eliminated due to the requirement that some conductors cross others.

SUMMARY OF THE INVENTION

Connectors are positioned at spaced apart positions separated by the requisite distance and a die positioned therebetween. The die acts to guide the wires from an entry point to an exit point. The wires are then gang fed or individually fed into the entry point and through the die to the exit point and beyond. The wires are then trimmed to length and pressed into the insulation displacement connector to complete the connection.

The die may be as simple as a tube with the ends positioned appropriately, or a block of material with grooves cut therein to act as guiding channels. The grooves may be formed in any desired deviation to route the wire to the desired exit point. With the use of either deflectors or a separator between the die parts, the wires may be crossed over other wires to position the ends at positions as desired.

It is an object of the invention to permit automation of the fabrication of wiring networks.

It is a further object of the invention to permit efficient interconnection of connectors in a non uniform pattern.

DRAWING

DETAILED DESCRIPTION OF THE INVENTION

Figure 1:
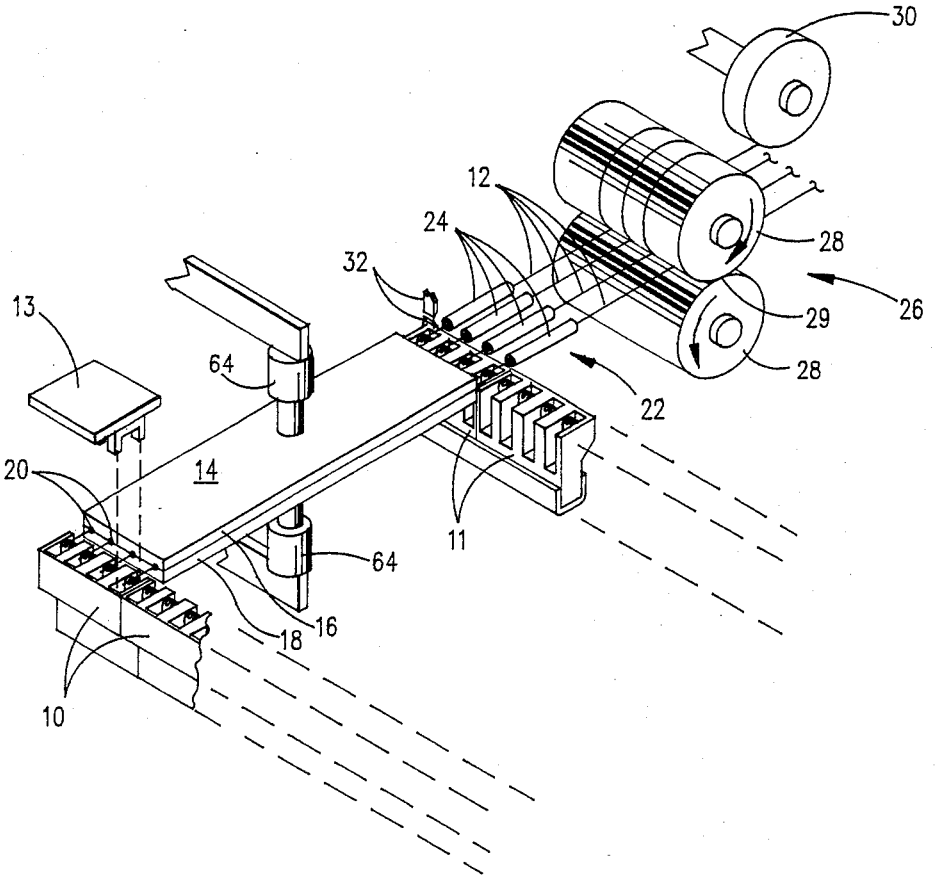
FIG. 1 is a drawing showing the positional relationship of the elements of the wiring harness and the wire feeding, guiding and cutting mechanisms.

Referring to FIG. 1, it is seen that the connectors 10, 11 are positioned at spaced apart locations which are dictated by the length of the wiring network to be fabricated. The connectors 10, 11 may be the same or may be of different configuration, depending upon the type device to which they respectively connect. To guide the wires 12 from a terminating point adjacent one of the connectors 10, 11 to a terminating point adjacent the other connector 11, 10 a die 14 is positioned with entry and exit points slightly above the top plane of the connectors 10, 11. The die 14 is comprised of a top plate 16 and a bottom plate 18. One or both plates 16, 18 may have grooves or channels 20 cut or formed in the plate. The grooves 20 may traverse the plate 16 or 18 from one end to the other in a straight line or deviate in a serpentine shape as required by the electrical circuitry to which the connectors 10, 11 will connect.

In order to feed the wires 12, a wire guide 22 is positioned adjacent one of the connectors 11 and aligned with the entry point of the die 14. The wire guide 22 may conveniently be a single guide tube 24 or a gang guide where several passages are formed into a single member. The wire guide 22 provides the proper placement of the wire 12 for smooth entry into the die 14. The wires are pushed through the wire guide 22 by a wire pusher 26. Wire pusher 26 may comprise a pair of feed rolls 28 positioned to form a pressure nip 29 therebetween. The wires 12 are fed to the nip of the feed roll 28 pair and as the feed roll pair 28 drives, the wires are pulled from the wire supply 30 which may take one of several forms, such as a reel, coil or discrete short lengths.

To sever the wires 12 at the point where the wires 12 cross the connector 11, a cut off 32 is provided. The cut off 32 may take a number of forms but is most advantageously configured as a shear.

The connectors 10, 11 may typically be of the insulation displacement connector type, commonly referred to as IDC's. The use of IDC's allows the easy insertion of the wires 12 into the connectors 10, 11. Gang wire presses 13 are readily available from connector manufactures, which are capable of forcing the entire set of wires 12 into the connectors 10, 11 in a single operation. Such a gang wire press 13 may be positioned over each connector 10, 11 so that the wires 12 may be pressed into the connectors 10, 11 after the wires 12 are severed from their supplies 30.

Figure 2:
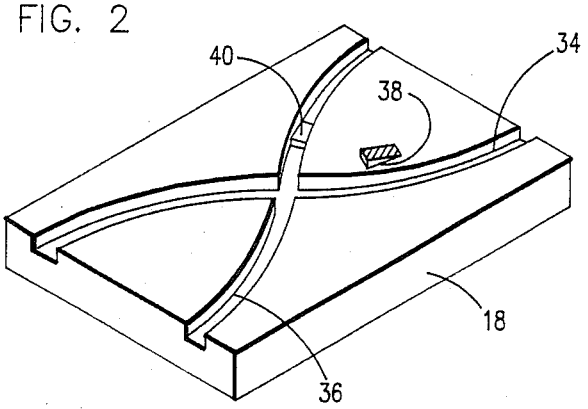
FIG. 2 is an illustration of the die for guiding the wires, of the device of FIG. 1, wherein the channels are of serpentine shape and have a crossover point and deflectors to aid in the feeding of the wires.

A very significant key to the flexibility of a device as is described herein is the die 14. Referring to FIG. 2, the die 14 is illustrated as a plate 18 having channels 34, 36 formed in the top surface thereof, to guide the wires 12 and route them to terminating positions at one connector, which do not necessarily correspond to the positions at the connector. The channels 34, 36 illustrated are illustrative of several characteristics that the channels may have. The channel 34 is a serpentine channel and displaces the wire exit laterally from the entry point. Additionally, channel 34 crosses channel 36. The depth of the channels 34, 36 is a matter of design choice, but must be in excess of two wire diameters at the point of crossover.

The problem of wire jamming in the channels 34, 36 is addressed by the use of deflectors 38, 40. Deflectors 38, 40 may be positioned in or formed in the channels 34, 36. The deflectors 38, 40 are provided in the channels 34, 36 to cause one of the wires 12 to be raised up from the floor of the channel 34 while the wire in channel 36 is caused to deflect downwardly to pass under the wire 12 in channel 36.

Figure 3:
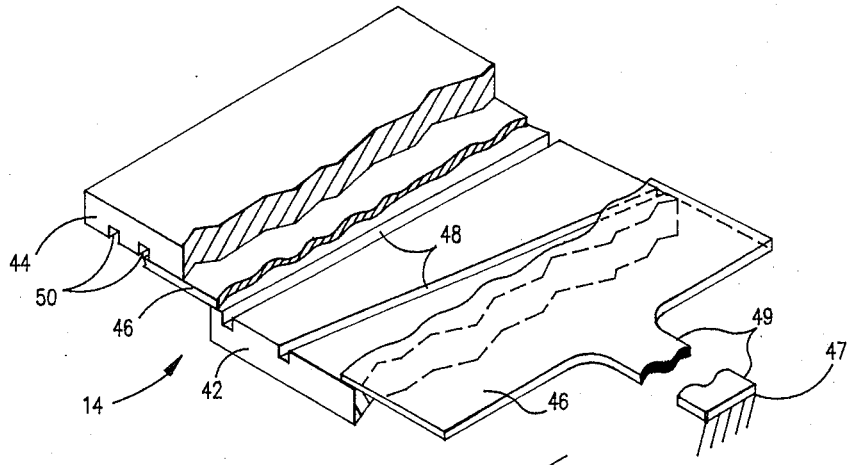
FIG. 3 is an illustration of the die with a separator member positioned between the two halves of the die.

FIG. 3 illustrates another embodiment of the die 14. In this embodiment, the parts of the die are a bottom plate 42, a top plate 44 and a separator plate 46. The channels 48 in the bottom plate will tend to be channels all deviating in the same direction or at least not crossing other channels. The channels 50 in the top plate 44 will likewise all tend to deviate in the opposite direction, to that of the channels 48, or at least not crossing other channels 48. The separator plate is positioned between the two plates 42, 44 and in effect forms two separate and distinct die sets. Crossovers in this type die do not intersect and therefore do not require that the wires be deviated as in the die 14 as shown in FIG. 2. The two approaches shown in FIG. 2 and FIG. 3 may be combined in a single die and handle more complex routing requirements.

Figure 4:
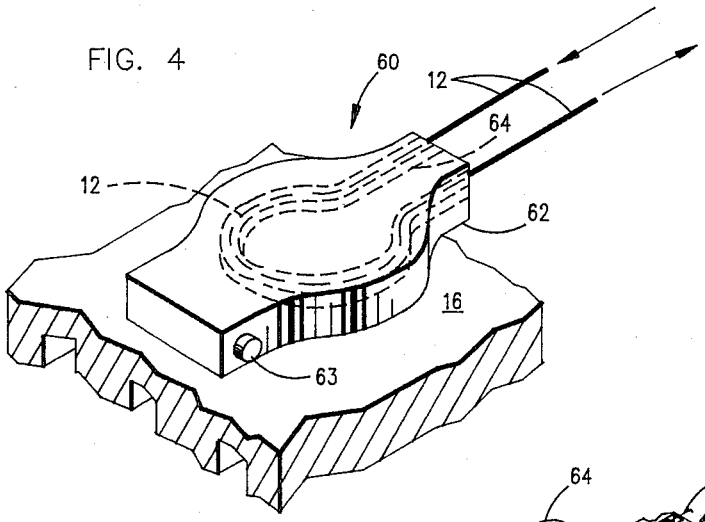
FIG. 4 illustrates a die for the feeding of shunts.
Figure 5:
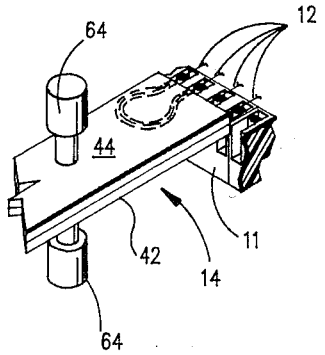
FIG. 5 illustrates an alternate embodiment of a shunt die.

FIG. 4 is the illustration of a shunt die 60. The shunt die 60 may be formed as part of a die plate and could be used most advantageously in the type of die that is illustrated in FIG. 3, having a separator plate 46. If room does not permit the inclusion of a shunt die 60 in one of the main die plates 42, 44, the shunt die 60 may be piggy backed on the top plate 44 of the die 14. The shunt die 60 in FIG. 4 is a block 62 which has had a loop channel 64 cut therein. Thus, when the wire 12 is fed into the shunt die 60 the wire 12 will loop back to a position on the connector adjacent the entry point to the shunt die 60. Thus, two positions on the same connector 10 can be connected or shunted. The shunt die 62 may be opened by an air cylinder, not shown, or other mechanical device to permit the removal of the loop from the die 60.

In order to accommodate different entry point levels, the positioning of the die 14 may be varied such that a first level of channels may be presented to the wires 12 and then a second level of channels may be presented to the wires 12. This technique will simplify the die 14 for particularly complex routings. This technique is also applicable to the use of a piggy backed shunt die 60.

In the event that multilevel dies 14 are used, the die positioning means 64, used to open and close the die 14 may be adapted to shift the die 14 in a direction normal to the plane of the die 14. The die positioning means 64 may be a hydraulic or pneumatic cylinder or cylinders which extend or retract to move the top and bottom plates 42, 44. If a separator plate 46 is used, it may be positioned on a support 47 such that it remains relatively fixed, or the support arm 49 may be weak enough to flex permitting the separator plate to move slightly to accommodate the movement of the plates 42, 44. Alternatively, the separator plate may be fabricated out of sheet spring stock and an arm extended to allow for such movement. Thus, the die 14 with a piggy backed shunt die 60 may be shifted to form the shunt as a separate step from the feeding of the wires 12 for the main network.

The wire pusher 26, as in FIG. 1, may be provided as a series of separate wire pushers, each operating on a single wire 12. With each wire 12 individually fed, the length of the wire 12 may be controlled to avoid waste and selected wires 12 may be fed independent of others and thus provide increased flexibility in the forming of wiring networks where it is desirable to shift a multi level die 14 to accommodate multiple levels of entry points to the die 14.

OPERATION OF THE INVENTION

Connectors 10, 11 are positioned at their desired position and the die 14 brought by the die positioning means 64 into the space between the connectors 10, 11, in effect closing the die 14. The entry points to the die 14 are located aligned with the axis of the wires 12. The wire pusher 26 is then activated to push the wires 12 through the wire guide 22 and into the die 14. The wire 12 is pushed until the the wire 12 extends through the die 14 and extends over the connector 10 adjacent the exit point of die 14. The wire cut off means 32 is activated to sever the extended portion of the wires 12 from the wire supply 30. The gang wire presses 13 are forced against the wires 12 and the connectors 10, 11 to connect the wires 12 with the connectors. The die 14 must now be opened to allow the wires 12 to be moved from the work station. If the die is provided with a separator plate 46, the wires 12 will be on one side or the other of the separator plate 46 and may be moved in a direction parallel to the plane of the separator plate 46.

If a wiring harness is sufficiently complex to warrant the use of a multi level die 14 which needs to be shifted to align different levels of entry points with the wires 12, several wire feeding operations may take place at different levels, prior to the use of the gang wire press 13 to effect the connection with connectors 10, 11.

After the die 14 is separated, the network with the attached connectors 10 is moved out of the work station and the die 14 closed and the process repeated.

The positioning of the connectors 10, 11 may be accomplished by conventional means such as vibrator bowls and chutes, and the operations of the die positioning means 64, cut off 32 and wire pushers 26 may be controlled by a computer or special purpose electronic controls.

I claim:

1. A wiring network fabrication apparatus for assembling a plurality of connectors and a plurality of conductors comprising:

means for supporting said connectors in spaced apart relation;

means for guiding said conductors from terminating positions at one of said connectors to terminating positions at the other of said connectors and for directing said conductors in paths that deviate said conductors to non corresponding positions at said connectors;

means for feeding said conductors through said means for guiding; and means for severing said conductors to a desired length with said conductor ends adjacent said connectors.

2. A wiring network fabrication apparatus as in claim 1, further comprising means for positioning said guiding means intermediate said connectors.

3. A wiring network fabrication apparatus as in claim 1, wherein said means for guiding said conductors comprises a member with passages extending from points adjacent said terminating positions of one of said connectors to points adjacent said terminating positions of the other of said connectors.

4. A wiring network fabrication apparatus as in claim 3 wherein said passages are openable to facilitate removal of said conductors.

5. A wiring network fabrication apparatus as in claim 3 wherein said means for guiding comprises a pair of members, each of which comprise at least a passage, said members moveable from a juxtaposed position to a separated position, whereby said conductors may be fed through said passages while said members are in a juxtaposed position and removed when said members are in a separated position.

6. A wiring network fabrication apparatus as in claim 3 wherein said means for guiding comprises a pair of members, at least one of which comprises at least a plurality of passages, said members moveable from a juxtaposed position to a separated position, whereby said conductors may be fed through said passages while said members are in a juxtaposed position and removed when said members are in a separated position.

7. A wiring network fabrication apparatus as in claim 5 where said passages further comprise a deflecting means for deflecting said conductors, whereby one said conductor may pass by another of said conductors without jamming in said passages.

8. A wiring network fabrication apparatus as in claim 6 where said passages further comprise a deflecting means for deflecting said conductors, whereby one said conductor may pass by another of said conductors without jamming in said passages.

9. A wiring network fabrication apparatus as in claim 5 wherein said means for guiding further comprises a separation means positionable between said members for isolating said passages of one of said members from communicating with said passages of said other of said members.

* * * * *